United States Patent [19]

Kiuchi et al.

[11] Patent Number: 5,026,192

[45] Date of Patent: Jun. 25, 1991

[54] LIQUID APPLICATOR

[75] Inventors: Toshiaki Kiuchi, Yachiyo; Shigeo Iizuka, Funabashi, both of Japan

[73] Assignee: Yoshino Kogyosho Co., Ltd., Tokyo, Japan

[21] Appl. No.: 542,982

[22] Filed: Jun. 25, 1990

Related U.S. Application Data

[63] Continuation-in-part of Ser. No. 343,955, Apr. 27, 1989, abandoned.

[30] Foreign Application Priority Data

Apr. 28, 1988 [JP] Japan ..... 63-58113

[51] Int. Cl.[5] ..... A46B 11/02

[52] U.S. Cl. ..... 401/176; 401/135; 401/141; 401/274

[58] Field of Search ..... 401/135, 141, 190, 274, 401/176

[56] References Cited

U.S. PATENT DOCUMENTS

| | | |
|---|---|---|
| 519,223 | 5/1894 | Bailey . |
| 1,138,772 | 5/1915 | Matthews . |
| 1,207,121 | 12/1916 | Zeidler . |
| 1,348,681 | 8/1920 | Wright . |
| 1,557,357 | 10/1925 | Gornell . |
| 2,293,211 | 8/1942 | Mureau . |
| 2,623,231 | 12/1952 | Gutenstein . |
| 3,140,695 | 7/1964 | Fehling et al. . |
| 3,167,806 | 2/1965 | Hogan . |
| 3,181,539 | 5/1965 | Aston . |
| 3,351,074 | 11/1967 | Aston . |
| 3,359,992 | 12/1967 | Cishek et al. . |
| 3,468,612 | 9/1969 | Aston . |
| 4,033,700 | 7/1977 | Spatz . |
| 4,309,119 | 1/1982 | Wittersheim . |
| 4,405,249 | 9/1983 | Scales . |
| 4,433,799 | 2/1984 | Corsette . |
| 4,624,594 | 11/1986 | Sasaki et al. . |
| 4,655,690 | 4/1987 | Boedecker et al. . |
| 4,776,717 | 10/1988 | Iizuka et al. . |
| 4,808,022 | 2/1989 | Iizuka et al. . |
| 4,852,772 | 8/1989 | Ennis, III . |

FOREIGN PATENT DOCUMENTS

| | | |
|---|---|---|
| 165657 | 10/1955 | Australia . |
| 62059/65 | 2/1967 | Australia . |
| 51333/73 | 10/1973 | Australia . |
| 0007273 | 1/1980 | European Pat. Off. . |
| 0123518 | 10/1984 | European Pat. Off. . |
| 199597 | 10/1986 | European Pat. Off. . |
| 2630569 | 1/1978 | Fed. Rep. of Germany . |
| 959036 | 3/1950 | France . |
| 1534861 | 5/1969 | France . |
| 2551636 | 3/1985 | France . |
| 552673 | 12/1956 | Italy . |
| 62-86111 | 6/1987 | Japan . |
| 63-52511 | 4/1988 | Japan . |
| 136990 | 8/1952 | Sweden . |
| 688891 | 3/1953 | United Kingdom . |
| 1562817 | 3/1980 | United Kingdom . |
| 2150424 | 7/1985 | United Kingdom . |

*Primary Examiner*—Steven A. Bratlie

*Attorney, Agent, or Firm*—Oliff & Berridge

[57] ABSTRACT

A liquid container comprising a main member, a cylinder and a container body. The main member has a barrel, a head fitted in an upper portion of the barrel, a discharge section provided at an upper end of the head, a passage cylinder communicating with the discharge section and extended downwardly into the upper portion of the barrel, a cylindrical piston formed at a lower end of the passage cylinder, and a resilient discharge valve in the passage cylinder. The cylinder is movably inserted into the barrel to be elevationally movably engaged with an outer surface of the lower portion of the passage cylinder and to be resiliently urged downwardly. The cylinder has a suction valve at a its lower end thereof. The container body is movably inserted into the barrel. The liquid in the container body is pressurized by the intrusion of the slidable bottom plate, air bubbles adhered to the ball valve body of the suction valve are thus compressed and isolated from the ball valve body, again mixed within the liquid, and discharged together with the liquid through the discharge valve.

9 Claims, 2 Drawing Sheets

LIQUID APPLICATOR

This application is a continuation-in-part of U.S. Ser. No. 07/343,955, filed Apr. 27, 1989, now abandoned.

BACKGROUND OF THE INVENTION

1. Field of the Invention

This invention relates to a liquid container and, more particularly, to a bottom cover of a liquid container.

2. Related Art

Japanese Utility Model Laid-open No. 62-86111 discloses a liquid container with a toilet writing brush. The container has a main member, a cylinder and a container body. The main member has a barrel, a head engaged with an upper end of the barrel, and a brush tip erected from an upper end of the head. A passage cylinder communicating with the brush tip extends into an upper portion of the barrel. A cylindrical piston is formed at a lower end of the passage cylinder. A discharge valve is formed in the passage cylinder and resiliently closed. The cylinder is positioned movably within the barrel, is elevationally movable to an outer surface of a lower portion of the passage cylinder, and is urged downwardly to be engaged. The cylinder has a suction valve of a ball valve type at its lower end portion. The container body is movably positioned within the barrel. A neck portion of the container body is tightly engaged with an outer surface of a lower portion of the cylinder. The container body has a slidable bottom plate. The slidable bottom plate is forced from the lower end of the barrel into the barrel.

When the container body intrudes into the barrel when the container is laid down, the cylinder with the container body intrudes into the passage cylinder with the piston. Accordingly, liquid in the cylinder is pressurized, the liquid in the cylinder causes the discharge valve to open so as to be supplied to the brush top. When the pressing of the container is stopped so that the liquid pressure in the cylinder becomes lower than the resilient force of the discharge valve, the discharge valve is closed, and the container body and the cylinder are returned by a returning spring. Therefore, the interior of the cylinder is evacuated to open the suction valve, and the liquid in the container body is sucked into the cylinder. When the interior of the cylinder is evacuated, the slidable bottom plate rises upwardly in the container body to compensate for the negative pressure therein.

In the conventional liquid container with the toilet writing brush described above, toilet solution to the brush tip is often accidentally stopped during use, and even if the container body is urged to the barrel, the supply of the solution might become insufficient.

When the cause of this accidental stoppage was studied by the present inventors, it was discovered that, when particularly highly viscous toilet solution or cream-like fluid is employed, air bubbles mixed in the fluid adhere to the ball valve body of the suction valve, and when the quantity of the air bubbles adhered thereto increases, the suction valve stops its function, stopping the supply of the toilet solution.

SUMMARY OF THE INVENTION

Accordingly, it is a main object of this invention to provide a liquid container in which air bubbles adhered to a suction valve thereof can be easily removed to recover the function of the suction valve therein.

In order to achieve the above and other objects, there is provided according to the present invention a liquid container comprising: a main member (1) having a barrel (2), a head (3) fitted in an upper portion of the barrel (2), a discharge section provided at an upper end of the head (3), a passage cylinder (5) communicating with the discharge section and extending downwardly into the upper portion of the barrel (2), a cylindrical piston (6) formed at a lower end of the passage cylinder (5), and a resilient discharge valve (7) in the passage cylinder (5); a cylinder (8) movably inserted into the barrel (2) to be elevationally movably engaged with an outer surface of the lower portion of the passage cylinder (5) and to be urged downwardly; the cylinder (8) including a suction valve (10); and a container body (12) (12) having a neck portion (12*a*) tightly engaged with an outer surface of a lower portion of the cylinder (8); the container having slidable bottom plate (14), wherein a lower end of the container body (12) is closed by a bottom cover (15), and a hammer (16) is elevationally movably inserted into a gap between the bottom cover (15) and the slide bottom plate (14).

According to the liquid container of the invention, when the container is strongly axially fluctuated, the hammer (16) hits the movable bottom plate (14) to apply an impact to the slidable bottom plate (14). Thus, the slidable bottom plate (14) is intruded by the impact into the container body. The liquid in the container body is pressurized by the intrusion of the slidable bottom plate (14), air bubbles adhered to the ball valve body (9) of the suction valve are thus compressed and isolated from the ball valve body (9), again mixed within the liquid, and discharged together with the liquid through the discharge valve.

DESCRIPTION OF THE PREFERRED EMBODIMENTS

A container of the present invention comprises, similarly to a conventional container of this type, a main member, a cylinder and a container body.

Figure 1:
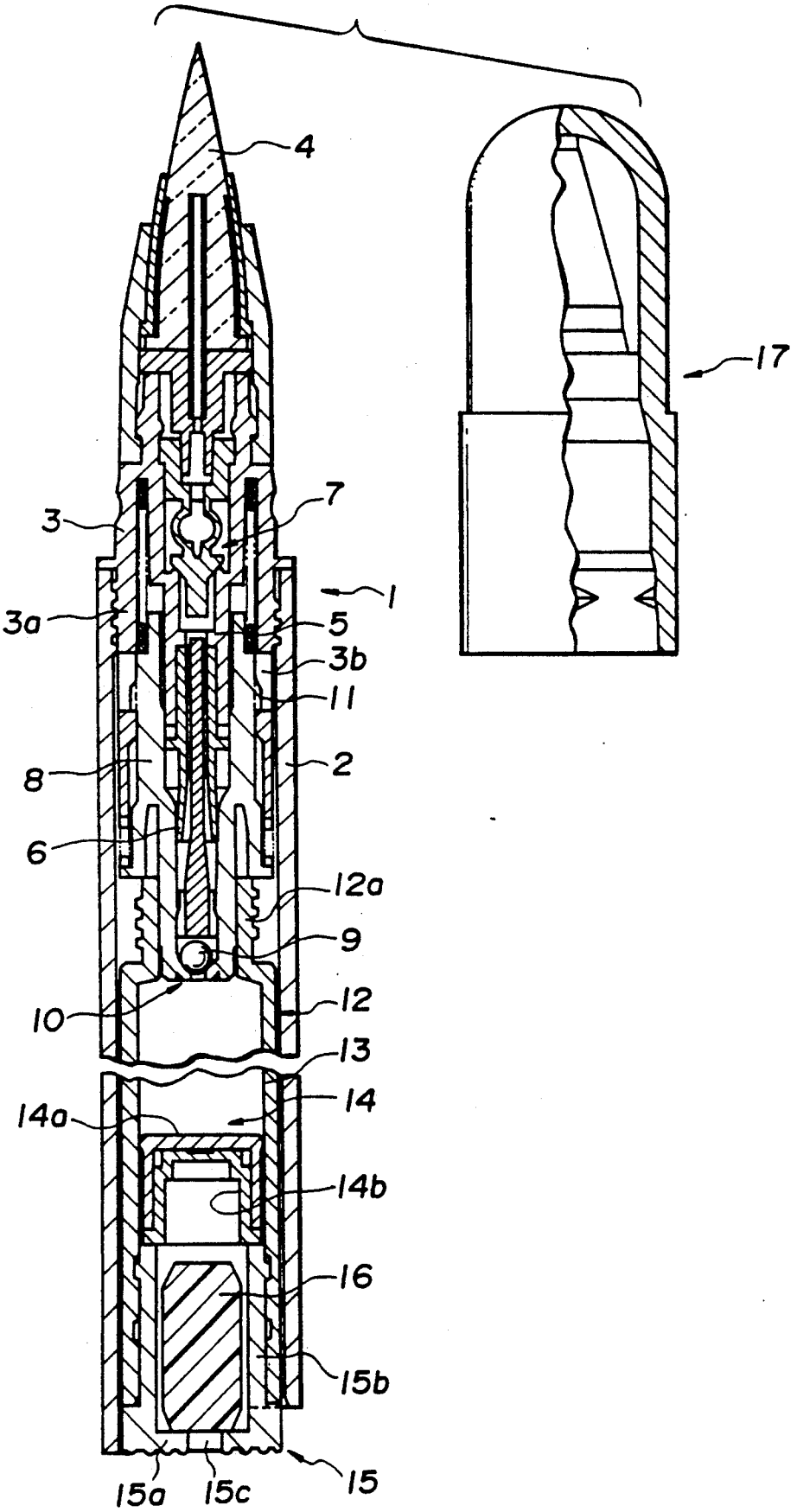
FIG. 1 is a longitudinal sectional view of a container according to the present invention, its cap having been removed.

In FIG. 1, a main member 1 has a barrel 2. A head 3 is fitted in an upper portion of the barrel 2 and a lower half of the head 3 is engaged within an upper end portion of the barrel 2. A liquid discharge section is provided at an upper end of the head 3. In an embodiment of the present invention shown in FIG. 1, a tip 4 of a toilet writing brush is erected at a top of the head 3. A passage cylinder 5 is extended downwardly into the barrel 2 and communicates with the tip 4 of the toilet writing brush. A cylindrical piston 6 is formed at a lower end of the passage cylinder 5. A discharge valve 7 is formed of a flexible material, is resiliently closed, and is provided in an upper portion of the passage cylinder 5.

An upper portion of a cylinder 8 is movably inserted into a peripheral wall 3*a* of the head 3 fitted in the upper portion of the barrel 2, and is also engaged elevationally movably telescopically with an outer surface of a lower portion of the passage cylinder 5. The cylinder 8 is resiliently urged downwardly by a spring. The cylinder 8 has a suction valve 10 of a ball valve 9 type at its lower end portion. Strips 11 and 11 are formed on an outer surface of the upper portion of the cylinder 8. The strips 11 are elevationally movably engaged within a long hole 3b longitudinally perforated at the peripheral wall 3a of the head 3 to thereby prevent the cylinder 8 from being moved out of the head 3.

A container body 12 has a neck portion 12a and a body portion 13. The neck portion 12a is engaged with the outer surface of the lower portion of the cylinder 8 to be movably positioned in the barrel 2. A slidable bottom plate 14 is hermetically sealingly engaged within the lower part of the body portion 13. The slidable bottom plate 14 is elevated in the body portion 13 in order to eliminate the negative pressure state in the body portion 13. The double construction slidable bottom plate 14 is formed of two members 14a and 14b in the embodiment in FIGS. 1 and 2, such as an inverted cup-shaped outer member 14a and an inner member 14b of the shape corresponding to the outer member 14a. Preferably, an outer member 14a is made of a soft resilient material, and an inner member 14b is made of a hard material. The hard and soft materials are, preferably, composed of a synthetic resin. In a preferred embodiment, the hard material of inner member 14b is capable of transmitting the impact when the hammer 16 hits the plate 14. However, a construction of the slidable bottom plate 14 is not limited to this particular embodiment in this invention. The inner member 14b is engaged within the outer member 14a, and an outer periphery of a top wall of the outer member 14a is hermetically sealingly contacted with an inner wall of the body portion 13. The container body 12 is telescopically movable in the barrel 2 and is forced from the lower end of the barrel 2 to the head 3.

In the present invention, a lower end of the container body 12 is closed by a bottom cover 15, and a hammer 16 is elevationally movably inserted into a gap between the bottom cover 15 and the slidable bottom plate 14. The bottom cover 15 comprises a bottom wall 15a and a peripheral wall 15b erected from a peripheral edge of the bottom wall 15a. The peripheral wall 15b of the bottom cover 15 has an outer small-diameter portion formed above the large-diameter portion. The outer small-diameter portion is engaged within a lower part of the container body portion 13, and has the same diameter as that of the body portion 13. The bottom cover 15 is telescopically movable into the lower portion of the barrel 2. An outer air flowing hole 15c is perforated at a center of the bottom wall 15a of the bottom cover 15. The hammer 16 may have a weight producing a force of the hammer 16 hitting the slidable bottom plate 14 so that upon fluctuating the liquid container, the force forces the slidable bottom plate 14 into the container body 12. The hammer 16 has a spherical or short columnar shape. Reference number 17 designates a cap.

Figure 2:
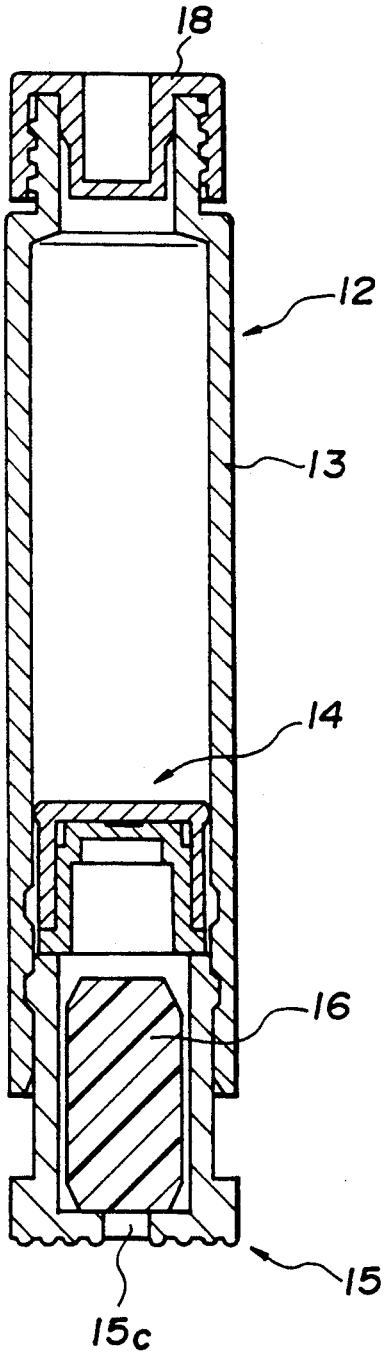
FIG. 2 is a longitudinal sectional view of a container body with a cartridge type bottom cover for use in the container of the invention.

As shown in FIG. 2, the container body 12 may be formed of a cartridge type. In other words, the container body 8 may be detachably engaged with the cylinder 8. In this embodiment, when the container body 12 is removed from the barrel 2, a plug 18 is engaged with the neck of the container body 12. When a container body is replaced or exchanged by another container body, the following operation is carried out. The bottom cover 15 is engaged initially in a shallow depth within the lower part of the body portion 13. The plug 18 is removed. The container body 12 is inserted into the barrel 2. The lower end of the cylinder 8 is engaged within the neck 12a. Then, as shown in FIG. 1, the bottom cover 15 is deeply intruded to thereby discharge the air in the cylinder 8, and the liquid in the container body is introduced into the cylinder 8.

According to the present invention as described above, the hammer 16 is elevationally movably engaged within the gap between the slidable bottom plate 14 and the bottom cover 15 as described above. Therefore, even when air bubbles are adhered to the ball valve body 9 of the suction valve to thereby lose the suction function as described above, the air bubbles can be isolated from the ball valve body by strongly fluctuating the container body to forcibly intrude the slidable bottom plate 14 into the container body, thereby immediately operating the suction valve.

What is claimed is:

1. A liquid container comprising:

a main member having a barrel, a head fitted in an upper portion of the barrel, a discharge section provided at an upper end of the head, a passage cylinder communicating with the discharge section and extended downwardly into the upper portion and towards the bottom of the barrel, a cylindrical piston formed at a lower end of the passage cylinder, and a resilient discharge valve in the passage cylinder:

an elevationally movable cylinder movably inserted into the barrel to be engaged with an outer surface of the lower portion of the passage cylinder and to be urged downwardly towards the bottom of the barrel; the cylinder including a suction valve;

a container body movably inserted into the barrel, the container body having a neck portion tightly engaged with an outer surface of a lower portion of the cylinder, and the container body having a slidable bottom plate, said slidable bottom plate comprising an outer member composed of a soft material and an inner member composed of a hard material;

wherein a lower end of the container body is closed by a bottom cover; and an elevationally movable hammer inserted into a gap between the bottom cover and the slidable bottom plate.

2. The liquid container according to claim 1, wherein said container body has a container body portion, the container body portion has a diameter;

said bottom cover comprises a bottom wall and a peripheral wall erecting from a peripheral edge of the bottom wall;

the peripheral wall comprising an outer large-diameter portion at a lower end thereof and an outer small-diameter portion formed above the outer large-diameter portion;

the outer large-diameter portion has a diameter same as the diameter of the container body portion; and an atmospheric air flowing hole perforates the center of the bottom wall.

3. The liquid container according to claim 1, wherein said hammer has a weight producing a force of the hammer hitting the slidable bottom plate so that upon fluctuating the liquid container, the force forces the slidable bottom plate into the container body.

4. The liquid container according to claim 1, wherein said hammer has a spherical shape.

5. The liquid container according to claim 1, wherein said container body is detachable engaged within said cylinder.

6. A liquid container comprising:

a main member having a barrel, a head fitted in an upper portion of the barrel, a writing brush tip extending away from an upper end of the head, a passage cylinder communicating with the writing brush tip and extended downwardly into the upper portion and toward the bottom of the barrel, a cylindrical piston formed at a lower end of the passage cylinder, and a resilient discharge valve in the passage cylinder;

a cylinder movably inserted into the barrel to be elevationally movably engaged with an outer surface of the lower portion of the passage cylinder and to be urged downwardly toward the bottom of the barrel; the cylinder including a suction valve of a ball body type at its lower end thereof; and a container body movably inserted into the barrel, the container body having a neck portion tightly engaged with an outer surface of a lower portion of said cylinder, and the container body having a slidable bottom plate, said slidable bottom plate comprising an outer member composed of a soft material and an inner member composed of a hard material;

wherein a lower end of the container body is closed by a bottom cover; and an elevationally movable hammer inserted into a gap between the bottom cover and the slidable bottom plate.

7. The liquid container according to claim 1, wherein said hammer has a short columnar shape.

8. The liquid container according to claim 1, wherein said soft material and said hard material comprise a synthetic resin.

9. The liquid container according to claim 6, wherein said soft material and said hard material comprise a synthetic resin.

* * * * *